United States Patent [19]

Sievers

[11] 4,313,432

[45] Feb. 2, 1982

[54] WATER DRIVEN PERSONAL MASSAGER

[76] Inventor: George K. Sievers, 1110 Kenwood St., Burbank, Calif. 91505

[21] Appl. No.: 77,892

[22] Filed: Sep. 24, 1979

[51] Int. Cl.[3] ..... A61H 9/00

[52] U.S. Cl. ..... 128/37; 128/66; 128/32

[58] Field of Search ..... 128/37, 66, 62 A, 32, 128/50, 47, 36

[56] References Cited

U.S. PATENT DOCUMENTS

| | | | |
|---|---|---|---|
| 890,709 | 6/1908 | Richwood | 128/37 |
| 1,025,504 | 5/1912 | Birrell | 128/37 |
| 1,225,752 | 5/1917 | Behm | 128/37 |
| 1,455,291 | 5/1923 | Hoffmann | 128/37 X |
| 3,213,471 | 10/1965 | Freeman | 128/62 A |
| 3,464,405 | 9/1969 | Kallus | 128/36 X |
| 3,537,444 | 11/1970 | Garn et al. | 128/66 |
| 4,007,735 | 2/1977 | Magnusson | 128/37 |

FOREIGN PATENT DOCUMENTS

| | | | |
|---|---|---|---|
| 171958 | 6/1906 | Fed. Rep. of Germany | 128/37 |
| 466893 | 2/1969 | Switzerland | 128/50 |

*Primary Examiner*—V. Millin

*Attorney, Agent, or Firm*—Wagner & Bachand

[57] ABSTRACT

Water driven personal massager for use in spas, hot tubs and like open-topped water enclosures suitable for bathing and having a pressurized water supply. The massager utilizes flow restricted pressurized water directed against a pulsating means to induce vibration in a hand holdable massager head coupled to the pulsating means in pulsation transmitting relation.

16 Claims, 9 Drawing Figures

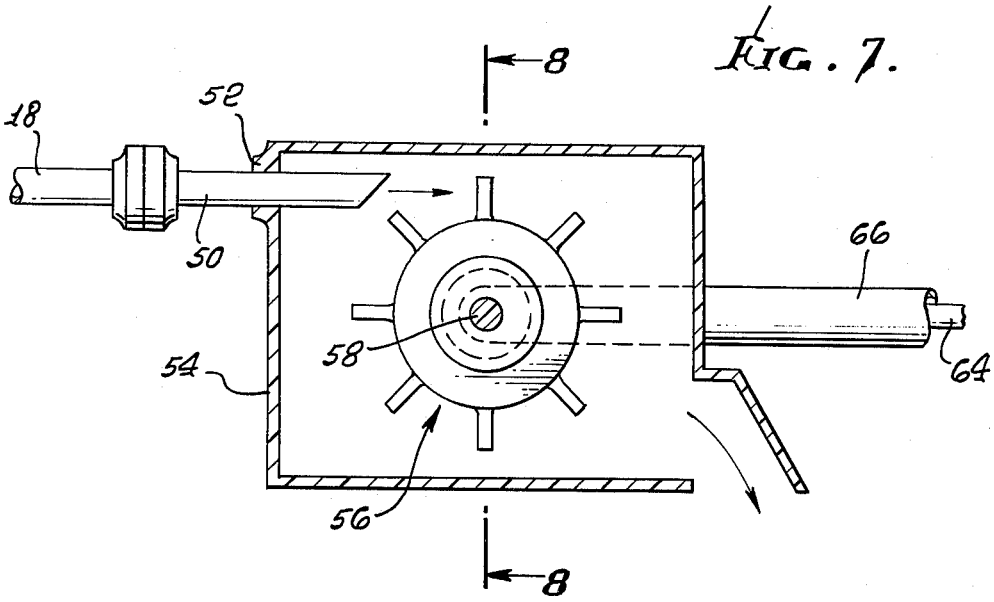
FIG. 7.
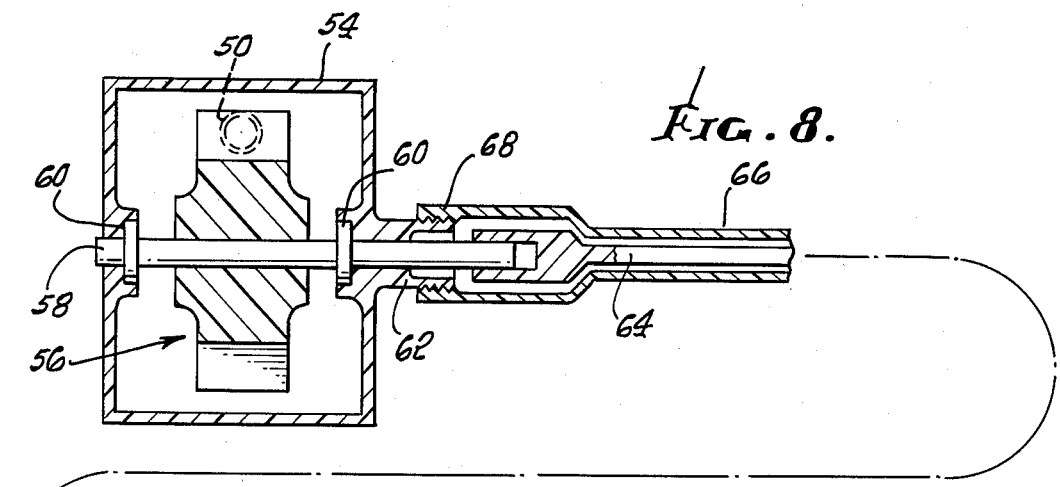
FIG. 8.
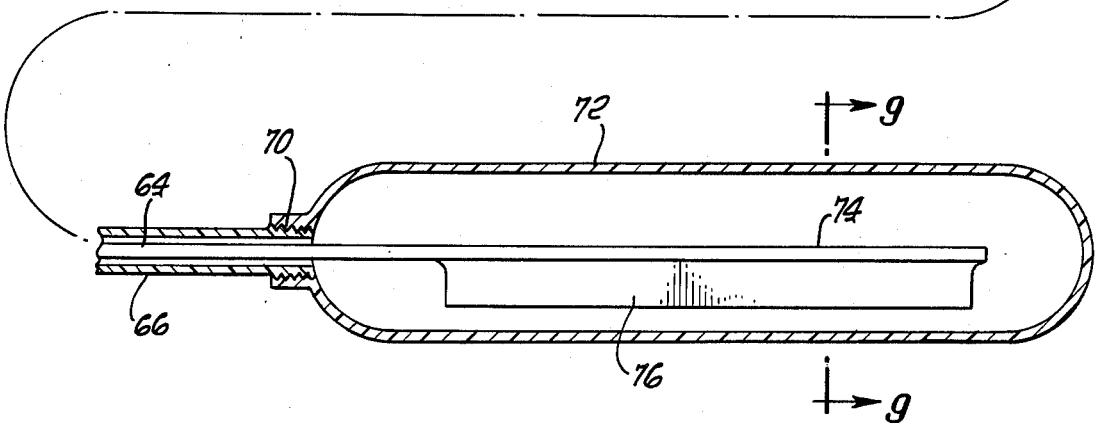
FIG. 9.
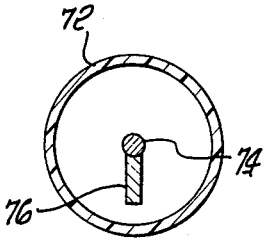

WATER DRIVEN PERSONAL MASSAGER

BACKGROUND OF THE INVENTION

This invention has to do with personal massage devices, and more particularly to such devices wholly hydraulically operated for convenience of use in spas, hot tubs and like bathing enclosures where a supply of pressurized water is available.

The widespread interest in hydrotherapy, manifested by the surge in installation and use of hot tubs and spas for recreative lounging, has prompted increased consumer discernment of relative advantages of one and another type of therapy. Simple hot water immersion and moderate to violent bubble therapy in cool to hot water are some of the variations currently available and advocated. Bubbles, particularly when strictly confined produce a vibratory sensation on the skin but necessary subsurface location of the bubble producing jets precludes obtaining these sensations on the lower scalp, the neck and shoulders of the bather. Other parts of the body cannot be juxtaposed to the jets either owing to their typical locations. Electrical vibration devices are known, of course, but common sense dictates that electrical appliances and water be kept as far apart as practicable.

Thus the need for localized hydromassage goes unfulfilled in presently known hot tubs and spas.

SUMMARY OF THE INVENTION

It is an object therefore of the present invention to provide apparatus for localized vibratory massage useful in or out of a spa or tub, and free of electrical connection or dependence.

It is another object to provide a hand holdable apparatus driven vibrationally by simple connection to the pressurized water supply of the spa or tub, and entirely by hydromechanical means.

These and other objects are realized in accordance with the invention in a water driven personal massager for use in spas, tubs and like open-topped water enclosures suitable for bathing and having a pressurized water supply, comprising means defining a flow passage providing a restricted flow path for the supply pressurized water, pulsating means across the flow path having pulsating response to water flow, and a hand holdable massager head coupled to the pulsating means in pulsation transmitting relation.

The invention further contemplates a human figure conformable pad mountable to the massager head, and adapted to sympathetically vibrate with the head pulsation. Typically the massager head is generally cylindrical and the massager includes conduit defining the flow passage means, and there may be provided conduit carried variable flow control means controlling conduit water flow in pulsation intensity controlling relation.

In particular embodiments, the invention contemplates the use of conduit defining the flow passage means, and having a conduit nozzle, the pulsating means comprising a turbine driven by water delivered by the conduit nozzle, the turbine comprising an eccentrically weighted assembly of a circular series of vanes and a common shaft. In these embodiments, the shaft is coupled to the massager head in pulsation transmitting relation.

The massager may be remote to the turbine in shaft-coupled relation, the shaft being eccentrically weighted within the massager head to induce water-driven turbine pulsations.

More particularly, the water driven personal massager may also include a housing, the conduit nozzle extending into the housing, the turbine being mounted within the housing for conduit delivered water-driven rotation, the turbine shaft having a flexible shaft extension extending beyond the wall of the housing, the shaft extension terminally carrying an eccentric weight, the massager head journaling the shaft extension and receiving the eccentric weight thereon for rotation freely within the head in turbine unbalancing and massager head pulsation producing relation.

In other embodiments, the conduit nozzles is received within the massager head, and the turbine is mounted within the massager head in conduit nozzle delivered water-driven relation. In such embodiments, the massager head is generally cylindrical, receives the conduit nozzle at one end, and beyond that end defines diametrically opposed bearings journaling the shaft of the turbine, the turbine then comprising a circular series of vanes fixed to a common shaft, the shaft being eccentrically weighted laterally of the vane series. Such embodiments further may include variable conduit flow control means to vary water flow within the conduit, and massager head pulsation response thereby.

In the foregoing embodiments, as noted, the massager head may be a generally closed cylinder and also may be locally ported for water discharge, the head defining opposed turbine shaft bearings for turbine rotation responsive to passage of pressurized water through the head to the discharge ports. In the last mentioned embodiment, radially disposed weights may be fixed to the shaft on opposite sides of the turbine vanes and in a common plane with each other and with one of the vanes.

The invention further contemplates provision of a pillow adapter, mountable over the cylinder and conformable to the human body in vibration transmitting relation.

In an alternate embodiment, the invention contemplates a water driven personal massager as previously described, but including, also, an axially apertured support block forming a continuation of the flow passage, and in which the pulsating means comprises a wobble plate supported in the block in pulsating responsive relation to water flow through the block, rather than a turbine. In this embodiment, the massage head again is generally cylindrical, the support block is centrally supported within the cylinder in annular space defining relation therewith, the block having a tubular inlet defining the continuation of the flow passage and an enlarged cavity therebeyond having a relatively restricted outlet into the massager head cylinder by-passing the annular space, the wobble plate being generally congruently formed with the cavity to have an enlarged base opposite the inlet, a pivot pin supporting the plate at its base within the cavity in wobbling relation responsive to water flow between the cavity inlet and outlet, and water exit ports beyond the support block cavity; the annular space defining water passageways to the exit ports.

In still another embodiment, the pulsating means may comprise a tubular Y-shaped flow passage-extending fitting having a base and first and second outlet legs coupled to the massage head, and self-actuating hydraulic control means for rapidly alternating water flow between the legs responsive to water flow in pulsation inducing relation for transmission to the massager head. In this embodiment the hydraulic-control means comprises first and second return tubes communicating water pressure in the first or second leg respectively with the base and oppositely to rapidly switch water flow from the higher water pressure leg to the lower water pressure leg in pulsation inducing relation.

Each of the foregoing embodiments is contemplated for use in combination with an open-top water receiving enclosure suitable for bathing and having a pressurized water supply.

In a highly particularly preferred form of the invention there is provided a water driven personal massager for use in spas, hot tubs and like open-topped water enclosures suitable for bathing and having a pressurized water supply, comprising an eccentric water turbine comprising a shaft, a circularly arranged series of like size and weight vanes fixed to the shaft, a coplanar pair of radially disposed weights bracketing the turbine series at a single predetermined vane, a water conduit flexibly coupled to the enclosure pressurized water supply, a conduit terminating in a nozzle aimed tangentially at the turbine vane series in driving relation; and a cylindrical massager head mounting the shaft and bodily responsive to eccentric weight distribution on the turbine shaft during rotation in pulsating relation, whereby pressurized water movement is converted into portable mechanical vibration applicable to the human body as desire determines.

In a second highly particularly preferred embodiment, the invention contemplates a water driven personal massager as described, comprising a water turbine having a shaft and laterally extended, flexible shaft extension, the shaft extension being terminally eccentrically weighted, a circularly arranged series of vanes fixed to the shaft, a water conduit flexibly coupled to the enclosure pressurized water supply, the conduit terminating in a nozzle aimed tangentially at the turbine vane series in driving relation; and a remote cylindrical massager head mounting the eccentrically weighted flexible shaft extension terminus and bodily responsive to eccentric weight distribution on the shaft during rotation in pulsating relation, whereby pressurized water movement is converted into portable mechanical vibration applicable to the human body as desire determines.

Still another embodiment of the invention comprises a support block pivotally mounting an eccentric wobble plate within an interior cavity, a water conduit flexibly coupled to the enclosure pressurized water supply, the conduit terminating at the support block cavity and opposite the wobble plate for conduit water driving of the wobble plate within the cavity; and a cylindrical massager head mounting said plate and bodily responsive to the eccentric movement of the wobble plate in pulsating relation, whereby pressurized water movement is converted into portable mechanical vibration applicable to the human body as desire determines.

In a still further particularly preferred embodiment of the invention, there is provided in a water driven personal massager a water conduit flexibly coupled to the enclosure pressurized water supply, a tubular Y-shaped fitting defining a nozzle on the conduit, a cylindrical massager head mounting the fitting and bodily responsive to fitting pulsations, and means inducing fitting pulsation responsive to water flow therethrough, the means including return tubes reactively communicating water pressure from the fitting legs alternately to the base in flow diverting relation to the opposite leg, whereby pressurized water movement is converted into portable mechanical vibration applicable to the human body as desire determines.

BRIEF DESCRIPTION OF THE DRAWINGS

The invention will be further described as to an illustrative embodiment thereof in conjunction with the attached drawing in which:

FIG. 7 is a longitudinal sectional view of the pulsator portion of another embodiment of the apparatus.

FIG. 8 is a transverse sectional view of the pulsator of FIG. 7 and a longitudinal sectional view of the remote massager head, connected schematically; and FIG. 9 is a transverse sectional view of the remote massager head taken on line 9—9 in FIG. 8.

DESCRIPTION OF THE PREFERRED EMBODIMENTS

Figure 1:
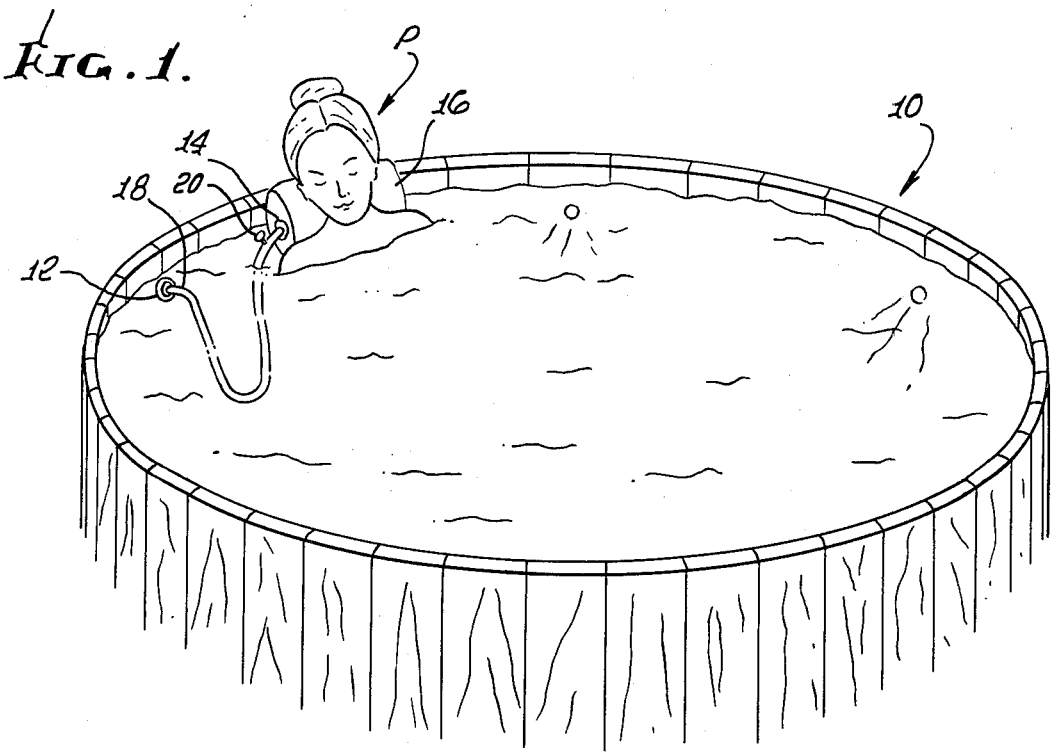
FIG. 1 is a perspective view of a spa apparatus in use with the present invention massager device.
Figure 2:
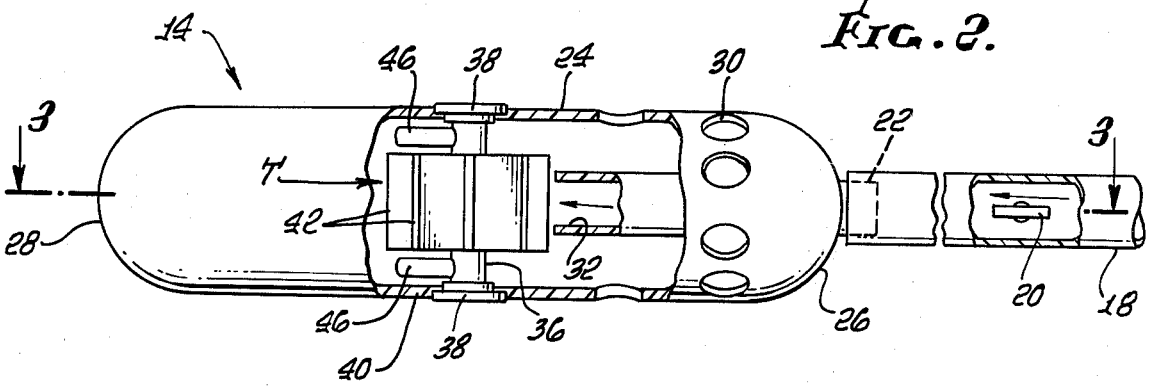
FIG. 2 is a plan view of the massager device, partly broken away to show underlying parts.
Figure 3:
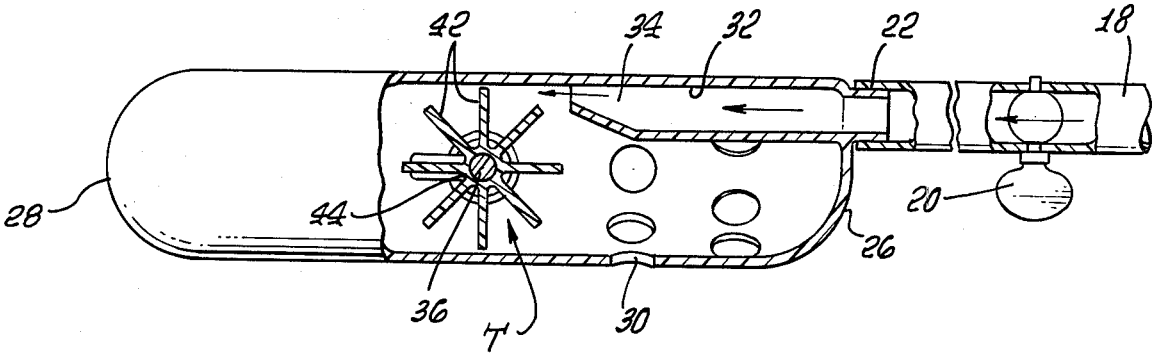
FIG. 3 is a side view thereof, taken on line 3—3 in FIG. 2.

With reference now to the drawing figures in detail, in FIG. 1, spa or hot tub 10 has a multiplicity of water inlets, one of which is shown at 12, and is sized and equipped for the recumbent user P to relax substantially immersed and caressed by swirling, bubbling water streams. Massager device 14 shown in detail in FIGS. 2 and 3, is but partially seen in FIG. 1 encased as it is in pillow 16. Pillow 16 supports the head, neck and shoulders of user P and as will be seen, with vibrational effects. Water, and air as may be, entering the tub 10 is return water from the supply within the tub recirculated by a pump (not shown) of conventional design. Filters, heaters and air blowers, also not shown, may be incorporated in the pressurized water system. The massager device hose or conduit 18 is temporarily plugged into inlet 12, and water is carried by the hose past valve 20, for controlling flow rate, to the massager device proper.

Turning now to FIGS. 2 and 3 particularly, hose 18 is press fitted onto nipple 22. Nipple 22 is formed at one end of massager head housing 24. The massager head 24 is suitably formed of durable plastic and is of a generally cylindrical shape with rounded end 26 on which nipple 22 is formed and rounded opposite end 28. A multiplicity of ports 30 are provided along the length of head 24 for water exit as will appear.

Nipple 22 constitutes the outer extension of an internal conduit 32 within head 24. Conduit 32 directs water entering it from hose 18 through nipple 22 toward a nozzle defining conduit portion 34. Water passing nozzle portion 34 accelerates and is directed tangentially against turbine T mounted transversely within head 24 on shaft 36 carried by bearing 38 formed in the sidewalls 40 of the head.

It will be noted that the turbine T comprises a circular series of vanes 42 supported on hub 44, each vane being like the other in size and thickness, and material, and thus weight. It will be further noted that shaft 36 carries, in addition to hub 44 and its uniform vanes 42, a pair of outboard weights 46 coplanar with each other and with a selected one of said vanes. The result of the presence of these weights, which are suitably metal, or metal filled, or otherwise heavy plastic is that the turbine T is eccentrically weighted and has a disuniform angular rotation momentum, whereby the turbine T chatters or vibrates, i.e. pulsates when rotated in its bearings 38. Bearings 38 being merely plastic sockets for shaft 36 ends, the vibration of turbine T is transmitted directly to head 24 which bodily vibrates driven by the eccentric rotation impacts of turbine T in bearings 38.

This vibration can be used to correspondingly vibrate a pillow, as in FIG. 1 where the head is simply held in a sleeve defined by the pillow, or the massage device can be applied to the feet, lower back, calves, thighs or wherever regular pulsing energy is needed or sought. Vigor of vibration can be controlled by valve 20, and by the placement and area of ports 30. Fewer, smaller ports will set up backpressures spoiling the turbine operation and particular port locations can be employed to direct water flow through the device, as will be apparent.

With reference now to an embodiment utilizing the eccentric turbine pulsator, but applicable at a remote location, reference is made to FIGS. 7, 8 and 9. There water conduit 18 from the pressurized water supply is coupled to nozzle structure 50 at fitting 52 in turbine housing wall 54. Turbine 56 is carried on shaft 58 journaled in bearings 60 carried by the housing wall 54. As will be seen the path of water is across the turbine inducing rotation. The shaft 58 extends beyond the housing wall 54 through externally threaded tubular boss 62; and is coupled into a flexible shaft extension 64 for common rotation therewith. Shaft extension 64 is enclosed within flexible, e.g. spiral wire tubing 66 which is resistant to kinking. Tubing 66 terminates at the chamber end in fitting 68 which is threaded onto boss 62. At the opposite end of tubing 66 another fitting 70 is provided onto which is threaded the massager head 72. The shaft extension 64 projects beyond fitting 70 centrally into head 72. The terminus 74 of shaft extension 64 carries an elongated weight 76, similar in purpose to weight 46. That is, as shaft extension 64 rotates in common with shaft 58 and turbine 56 driven by the water from conduit 18, the radially positioned weight 76 causes the shaft extension 64 to whip eccentrically, the resultant pulsations being shaft extension transmitted to the head 72. The just described embodiment enables use of the massager head beyond the confines of the spa or tub, since no water is emitted by the massager head.

Figure 4:
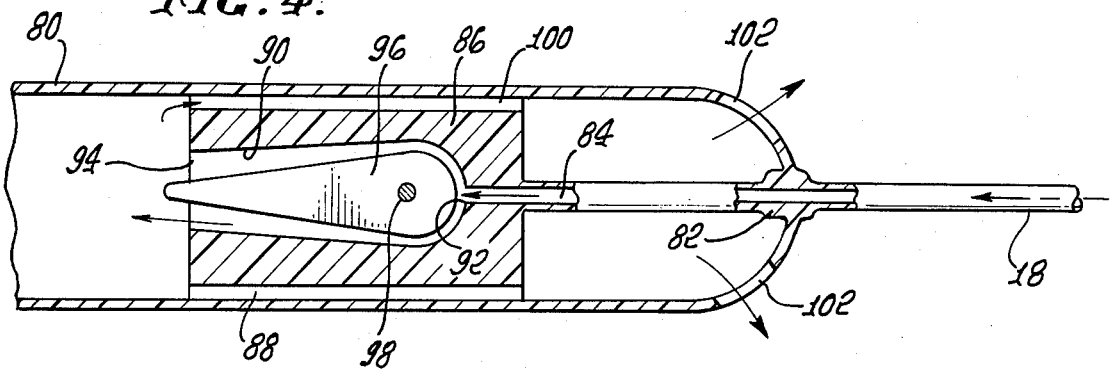
FIG. 4 is a longitudinal sectional view of an alternate form of the apparatus.

In another embodiment the pulsating means is of an oscillating type. Thus with reference to FIG. 4 a massager head 80, generally like that in FIGS. 1–3 is interiorly hollow and provided with terminal fitting 82 into which conduit 18 fits. Conduit nozzle 84 conveys the incoming water to a support block 86 maintained coaxial with the head 80 by spider 88. The support block 86 has a a central cavity 90 symmetrically formed about cavity inlet 92, to be substantially tear-shaped in cross-section as shown, with the cavity narrowing toward the open-cavity mouth 94. A wobble plate 96 is eccentrically pivotably mounted in cavity 90 on pin 98 for oscillation within the cavity. The eccentric pivoting of the wobble plate coupled with the onrush of water through the cavity and against the plate induces a pulsation which is transmitted through the spider 88 to the surrounding head, for local application of the massager head as previously described. The water is returned through annular space passage 100 circumferentially located about the support block to exit through ports 102.

Figure 5:
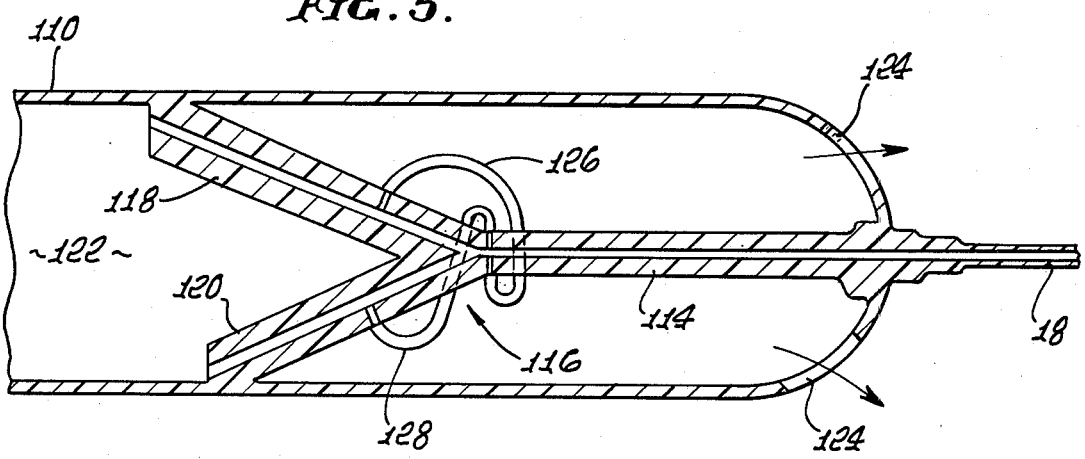
FIG. 5 is a longitudinal sectional view of another alternate form of the apparatus.
Figure 6:
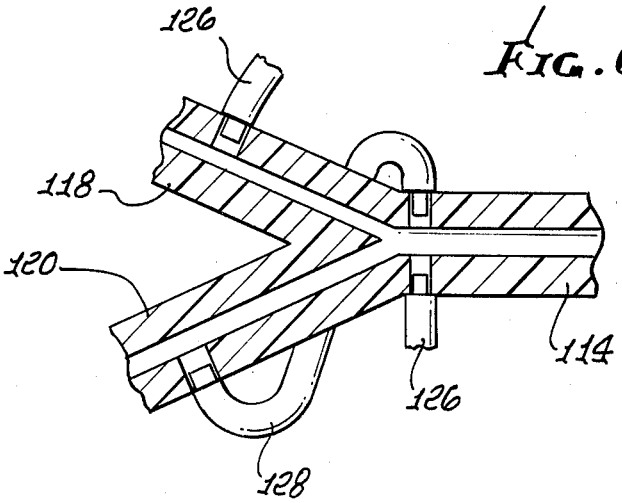
FIG. 6 is a fragmentary detail view of a portion of the apparatus shown in FIG. 5.

A form of the invention having no moving parts is shown in FIGS. 5 & 6. There massager head 110 is similar to the head of the just described embodiment, externally being generally cylindrical and interiorly hollow. Conduit 18 from the pressurized water supply is coupled with base 114 of Y-shaped fitting 116. The water flow divides at legs 118, 120, whence it flows into the head interior at 122 and on return is voided at ports 124. As shown in the Figure, a return tube 126 communicates flow in leg 118 with the flow in base 114; return tube 128 similarly communicates flow in leg 120 with flow in base 114 but oppositely to the return tube 126.

Operation of this embodiment is as follows: Water flowing in base 114 enters e.g. leg 118. The resultant increase in pressure in leg 118 forces some flow into return tube 126 whence the flow returns partially to the base 114. Returned water entering the existing flow in leg 114 enters opposite to the leg 118 from which it is being returned, so that water flow is diverted into the second, now lower pressure leg 120, then the return process is for leg 120 and return tube 128, causing flow to return to leg 118 whereby the just described sequence repeats, and so on, rapidly inducing pulsations in the Y-shaped fitting which are transmitted to the massager head 110 by the mechanical interconnection of the head and fitting.

Importantly, the present massager devices are free of electrical connection, and totally hydraulically powered, using only the available pressurized water supply of a hot tub or spa, and thus safe to use in or under water, in recreational tubs and spas, and in conventional tubs as well.

I claim:

1. Water driven personal massager for use in spas, hot tubs and like open-topped water enclosures suitable for bathing and having a pressurized water supply, comprising means defining a flow passage providing a restricted flow path for said supply pressurized water, pulsating means across said flow path comprising a turbine having a circular series of vanes on a common shaft, and radially disposed weights fixed to said shaft on opposite sides of said turbine vanes and in a common plane with each other and with one of said vanes.

2. Water driven personal massager according to claim 1, including also conduit defining said flow passage means, and conduit carried variable flow control means controlling conduit water flow in pulsation intensity controlling relation.

3. Water driven personal massager according to claim 1, including also a massager head, and a conduit nozzle received within said massager head, said turbine being mounted within said massager head in conduit nozzle-delivered water driven relation.

4. Water driven personal massager according to claim 3, including also a human figure conformable pad mountable to said massager head, and adapted to sympathetically vibrate with said head pulsations.

5. Water driven personal massager according to claim 3, in which said massager head is generally cylindrical.

6. Water driven personal massager according to claim 3, in which said shaft is coupled to said massager head in pulsation transmitting relation.

7. Water driven personal massager according to claim 3, in which said massager head is generally cylindrical, receives said conduit nozzle at one end, and beyond said end defines diametrically opposed bearings journaling the shaft of said turbine.

8. Water driven personal massager according to claim 7, including also a pillow adapter, mountable over said cylinder and conformable to the human body in vibration transmitting relation.

9. The massager claimed in claim 7 in combination with an open-top water receiving enclosure suitable for bathing and having a pressurized water supply.

10. Water driven personal massager according to claim 3, in which said massager head is a generally closed cylinder locally ported for water discharge, said head defining opposed turbine shaft bearings for turbine rotation responsive to passage of pressurized water through said head to said discharge ports.

11. The massager claimed in claim 1 in combination with an open-top water receiving enclosure suitable for bathing and having a pressurized water supply.

12. Water driven personal massager for use in spas, hot tubs and like open-topped water enclosures suitable for bathing and having a pressurized water supply, comprising a generally cylindrical massager head, means defining a flow passage including an axially apertured support block centrally supported within said head in annular space defining relation therewith, said block having a tubular inlet defining a continuation of said flow passage and an enlarged cavity therebeyond having a relatively restricted outlet into said head bypassing said annular space, a wobble plate defining a pulsating means, said wobble plate being generally congruently formed with said cavity to have an enlarged base opposite said inlet, a pivot pin mounted in said support block supporting said plate at its base within said cavity in wobbling relation responsive to water flow between the cavity inlet and outlet, and water exit ports beyond said support block cavity; said annular space defining water passageways to said exit ports.

13. The massager claimed in claim 12 in combination with an open-top water receiving enclosure suitable for bathing and having a pressurized water supply.

14. Water driven personal massager for use in spas, hot tubs and like open-topped water enclosures suitable for bathing and having a pressurized water supply, comprising means defining a flow passage providing a restricted flow path for said supply pressurized water, and pulsating means across said flow path comprising a generally cylindrical massager head, and within said head a tubular Y-shaped flow passage-extending fitting having a base and first and second outlet legs coupled to said massager head, and self-actuating hydraulic control means for rapidly alternating water flow between said legs responsive to water flow in pulsation inducing relation for transmission to said massager head.

15. A water driven personal massager for use in spas, hot tubs and like open-topped water enclosures suitable for bathing and having a pressurized water supply, comprising an eccentric water turbine comprising a shaft, a circularly arranged series of like size and weight vanes fixed to the shaft, a coplanar pair of radially disposed weights bracketing said turbine series at a single predetermined vane, a water conduit flexibly coupled to the enclosure pressurized water supply, said conduit terminating in a nozzle aimed tangentially at said turbine vane series in driving relation; and a cylindrical massager head mounting said shaft and bodily responsive to eccentric weight distribution on said turbine shaft during rotation in pulsating relation, whereby pressurized water movement is converted into portable mechanical vibration applicable to the human body as desire determines.

16. Water driven personal massager according to claim 7, including also variable conduit flow control means to vary water flow within said conduit and massager head pulsation response thereby.

* * * * *